US009181800B2

(12) United States Patent
Edelmann et al.

(10) Patent No.: US 9,181,800 B2
(45) Date of Patent: Nov. 10, 2015

(54) DEVICE FOR MONITORING THE STATE OF ROTATION OF A DISK CUTTER ARRANGEMENT OF A SHIELD TUNNEL BORING MACHINE AND DISK CUTTER ARRANGEMENT FOR A SHIELD TUNNEL BORING MACHINE

(75) Inventors: Thomas Josef Edelmann, Bühl (DE); Christian Himmelsbach, Schwanau (DE)

(73) Assignee: HERRENKNECHT AG, Schwanau (DE)

( * ) Notice: Subject to any disclaimer, the term of this patent is extended or adjusted under 35 U.S.C. 154(b) by 0 days.

(21) Appl. No.: 14/347,064

(22) PCT Filed: Sep. 14, 2012

(86) PCT No.: PCT/DE2012/000914
§ 371 (c)(1),
(2), (4) Date: Mar. 25, 2014

(87) PCT Pub. No.: WO2013/050010
PCT Pub. Date: Apr. 11, 2013

(65) Prior Publication Data

US 2014/0232167 A1 Aug. 21, 2014

(30) Foreign Application Priority Data

Oct. 5, 2011 (DE) ..... 10 2011 114 830

(51) Int. Cl.
*E21D 9/087* (2006.01)
*E21D 9/11* (2006.01)
*E21D 9/00* (2006.01)
*E21D 9/08* (2006.01)
(Continued)

(52) U.S. Cl.
CPC ..... *E21D 9/003* (2013.01); *E21D 9/081* (2013.01); *E21D 9/104* (2013.01); *E21D 9/108* (2013.01); *E21D 9/112* (2013.01)

(58) Field of Classification Search
CPC ..... E21D 9/003; E21D 9/081; E21D 9/104; E21D 9/112; E21C 35/24
USPC ..... 299/1.8
See application file for complete search history.

(56) References Cited

U.S. PATENT DOCUMENTS 3,791,705 A * 2/1974 Schimel ..... 384/571
5,181,577 A * 1/1993 Tsukamoto et al. ..... 175/261
(Continued)

FOREIGN PATENT DOCUMENTS

EP 0631033 A1 12/1994
EP 1503032 A1 2/2005
(Continued)

OTHER PUBLICATIONS

International Search Report and Written Opinion mailed Sep. 12, 2013 in parent PCT application No. PCT/DE2012/000914.

*Primary Examiner* — David Bagnell
*Assistant Examiner* — Michael Goodwin
(74) *Attorney, Agent, or Firm* — Faegre Baker Daniels LLP

(57) ABSTRACT

A compact monitoring device for monitoring the state of rotation of a disk cutter of a shield tunnel boring machine is integrated into a clamping element for fastening the disk cutter. A sensor module of the monitoring device is arranged in close proximity to the disk cutter but without touching so that a state of rotation of the disk cutter generated by transmitters mounted in the disk cutter is reliably ensured even under the rough environmental conditions prevailing in shield tunnel boring.

13 Claims, 6 Drawing Sheets

(51) Int. Cl.
*E21D 9/10* (2006.01)

(56) References Cited

U.S. PATENT DOCUMENTS

| | | | | |
|---|---|---|---|---|
| 5,421,422 | A * | 6/1995 | Crane et al. | 175/363 |
| 2005/0023882 | A1 * | 2/2005 | Burger et al. | 299/1.8 |
| 2009/0297273 | A1 * | 12/2009 | Lindbergh et al. | 405/138 |

FOREIGN PATENT DOCUMENTS

| | | | |
|---|---|---|---|
| EP | 1632645 | A1 | 3/2006 |
| JP | H0829276 | A | 2/1996 |
| JP | H08246796 | A | 9/1996 |
| JP | 2001152788 | A | 6/2001 |
| JP | 2003307095 | A | 10/2003 |
| WO | 2009/155110 | A2 | 12/2009 |

* cited by examiner

DEVICE FOR MONITORING THE STATE OF ROTATION OF A DISK CUTTER ARRANGEMENT OF A SHIELD TUNNEL BORING MACHINE AND DISK CUTTER ARRANGEMENT FOR A SHIELD TUNNEL BORING MACHINE

CROSS-REFERENCE TO RELATED APPLICATION

This application is a U.S. National Phase Patent Application based on International Application No. PCT/DE2012/000914 filed Sep. 14, 2012, the entire disclosure of which is hereby explicitly incorporated by reference herein.

BACKGROUND OF THE INVENTION

1. Field of the Invention

The invention relates to a device for monitoring the state of rotation of a disk cutter of a shield tunnel boring machine.

The invention furthermore relates to a disk cutter arrangement having a device of this type.

2. Description of the Related Art

A device according to the definition of the species and a disk cutter arrangement equipped with a device according to the definition of the species for a shield tunnel boring machine are known from WO 2009/155110 A2. The device known from the prior art has a base plate and a housing cover of a wedge-shaped design which is manufactured from a chamfered metal sheet. A number of modules, which have an acceleration sensor, a temperature sensor and a magnetic field sensor, are situated in a free end section of the housing cover which projects over the base plate in a retaining space which is thus open on one side. The base plate is situated to the side of a clamping screw shaft of a clamping screw belonging to a clamping unit for fixing a disk cutter axis. A connecting plate, through which the clamping screw shaft extends, is mounted on the base plate at right angles, thereby fastening the housing. The modules accommodated in the housing are connected via a wireless connection to a receiver, by means of which the measured values recorded by the sensors may be processed for monitoring the state of rotation of the disk cutter, whose axis adjoins the free end of the housing cover.

SUMMARY OF THE INVENTION

The present invention provides a device which has a very stable structure and is thus able to withstand the extremely harsh environmental conditions of a shield tunnel boring machine.

The present invention further provides a disk cutter arrangement having a device of this type, which maintains a high reliability in monitoring the state of rotation of a disk cutter.

The modules are well protected against damage due to the fact that the retaining space in the device according to the invention is closed on all sides. By designing the housing with a housing block which has a shaft channel accommodating the clamping screw shaft, the housing has a very stable connection to the clamping unit.

In one form thereof, the present invention provides a device for monitoring the state of rotation of a disk cutter of a shield tunnel boring machine, including a housing which has at least one retaining space for accommodating modules and is configured for mounting on a clamping unit designed for fastening a disk cutter axis of the disk cutter, characterized in that the or each retaining space is closed on all sides, and the housing has a housing block having the or each retaining space, the housing block being provided with an elongated bushing base as part of the fastening unit, which has a shaft channel extending in the longitudinal direction of the bushing base for accommodating a clamping screw shaft of the clamping unit.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
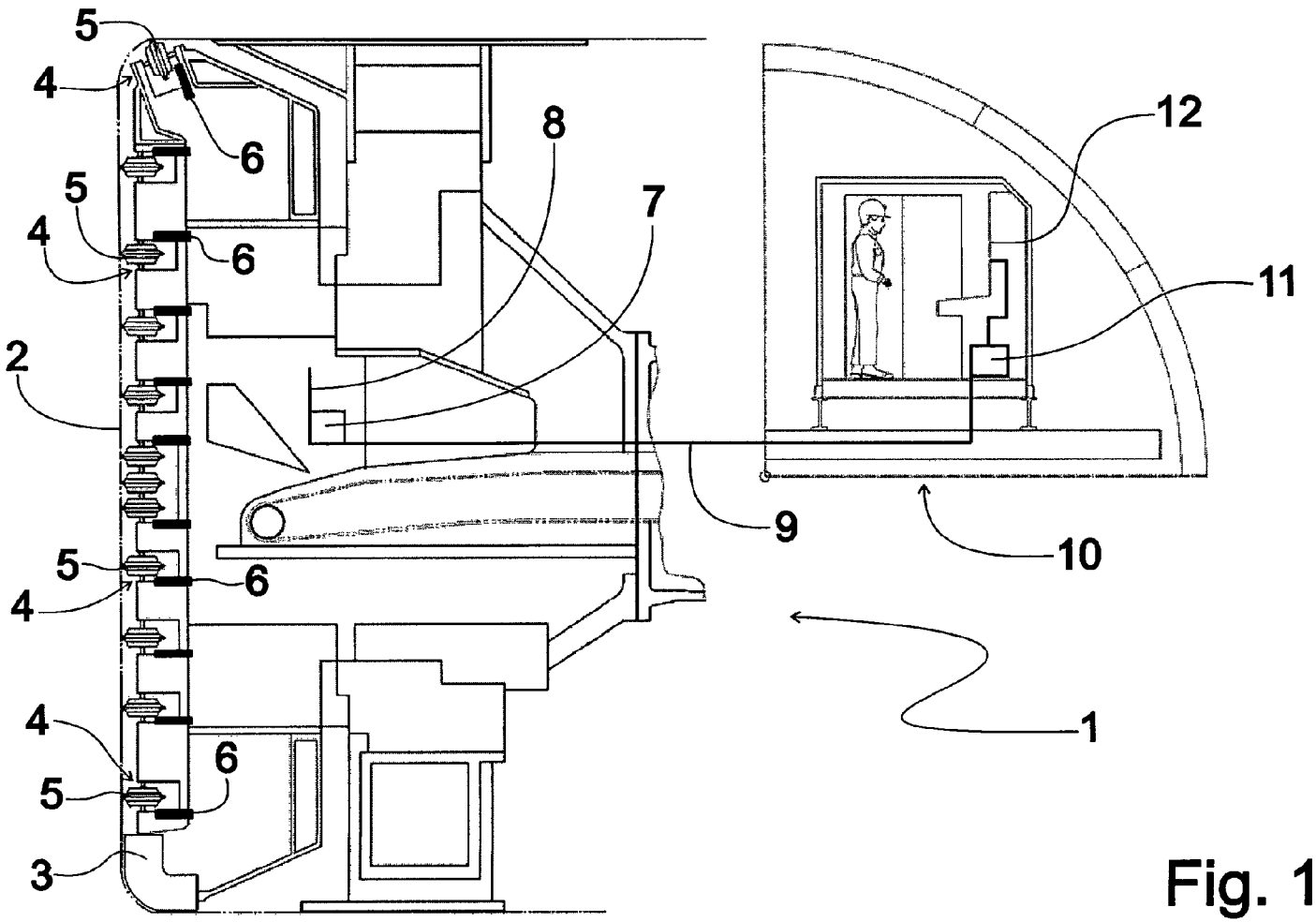
FIG. 1 shows a schematic view of a shield tunnel boring machine having a boring head which has a number of disk cutter arrangements provided with disk cutters, and which has a control station.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION

FIG. 1 shows a clear side view of a shield tunnel boring machine 1, which has a rotatable boring head 3 on the side facing an excavation face 2. Boring head 3 is fitted with a number of disk cutter arrangements 4, each of which has at least one disk cutter 5 adjoining excavation face 2 during excavation. Disk cutter arrangements 4 are equipped with at least one monitoring device 6 assigned to one disk cutter 5 as devices according to the invention, which are configured to monitor the state of rotation of particular disk cutter 5 of shield tunnel boring machine 1.

Monitoring devices 6 are preferably wirelessly connected to a receiver 7, which is configured to receive signals emitted by monitoring devices 6, for example in a so-called star network or mesh network configuration, via a receiving antenna 8 and to transmit them via a data line 9 of a data processing unit 11 situated in a control station 10 of shield tunnel boring machine 1. Data processing unit 11, in turn, is connected to a screen 12 of control station 10, on which the data assigned to the states of rotation of disk cutters 5 are displayed.

Figure 2:
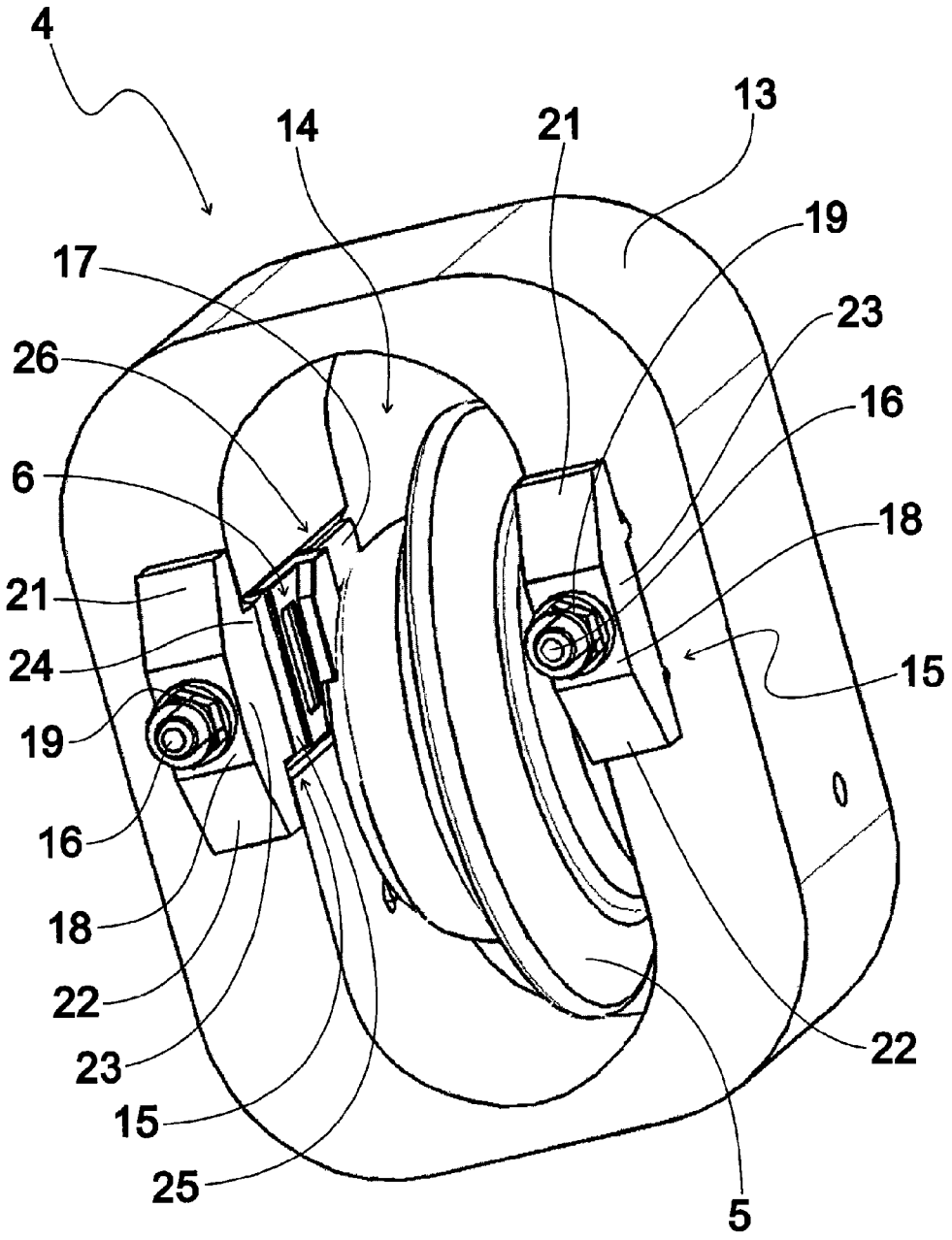
FIG. 2 shows a perspective view of an exemplary embodiment of a disk cutter arrangement, which has a disk cutter housing in which is situated a disk cutter which is fixed by clamping screws.

FIG. 2 shows a perspective view of an exemplary embodiment of a disk cutter arrangement 4 according to the invention, as is present in a shield tunnel boring machine 1 according to FIG. 1. Disk cutter arrangement 4 has a disk cutter housing 13 which has an oval shape closed in the manner of a ring. Disk cutter 5 is situated in a disk cutter retaining space 14 enclosed by disk cutter housing 13 on the edge, and it is connected to the disk cutter housing by engaging clamping units 15 on both ends of an axis, around which disc cutter 5 is rotatably supported. Each clamping unit 15 has a clamping screw 16, by means of which a clamping wedge 17 facing excavation face 2 (not illustrated in FIG. 2) during operation and a clamping block 18 on the side of disk cutter housing 13 facing away from excavation face 2 may be tensioned with respect to each other by tightening a tensioning nut 19 and thereby clamping the fixing of the ends of a disk cutter axis (not visible in FIG. 2) of disc cutter 5.

For tensioning purposes, clamping block 18 is provided with two edge tabs 21, 22 adjacent to an outside of disk cutter housing 13, between which a central section 23 crossed by clamping screw 16 is provided. An end section 24 of clamping block 18 extends from central section 23 in the direction of clamping wedge 17. Monitoring device 6 is situated between clamping wedge 17 and clamping block 18.

A spacer 25, which is adapted to the active length of clamping unit 15, is situated between monitoring device 6 and clamping block 18 to fix monitoring device 6 in the same relative arrangement to disk cutter 5 even in the case of different dimensions of disk cutter housing 13.

A retaining groove 26, in which monitoring device 6, clamping wedge 17 and end section 24 of clamping block 18 are situated, is provided in an inside of disk cutter housing 13 facing disk cutter retaining space 14. It is apparent from FIG. 2 that the same or essentially the same cross sections of end section 24 of clamping block 18 of monitoring device 6 and clamping wedge 17, or with the exception of only fractions of the overall dimensions, are configured in such a way that retaining groove 26 is essentially completely filled without any appreciable projection into disk cutter retaining space 14, so that monitoring device 6 is relatively well protected against mechanical damage.

Figure 3:
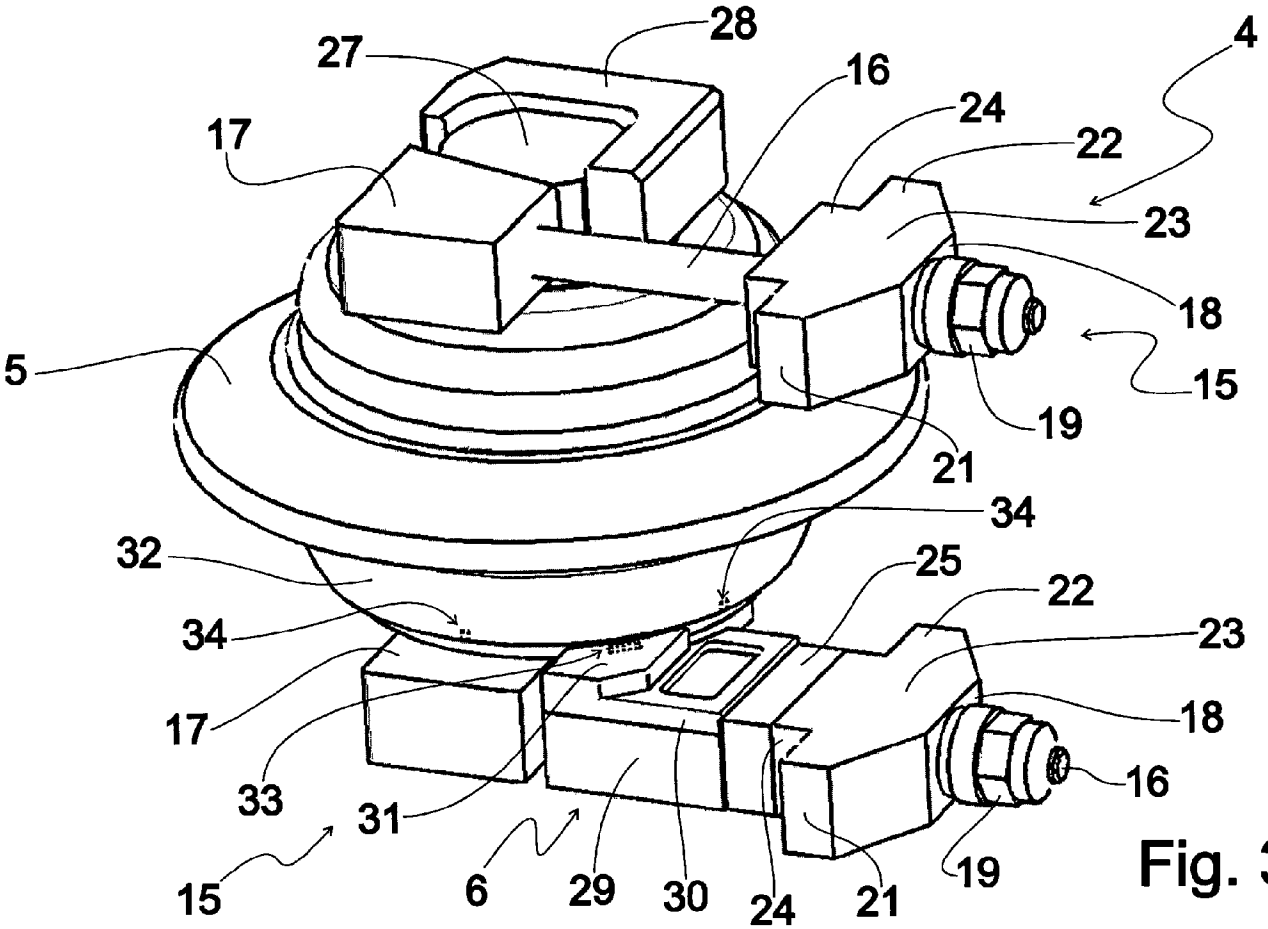
FIG. 3 shows a perspective view of the exemplary embodiment according to FIG. 2, in which the disk cutter housing is removed, with a view, in particular, of clamping wedges and clamping blocks connected to the clamping screw, as well as an exemplary embodiment of a device according to the invention, which is situated between a clamping wedge and a clamping block.

FIG. 3 shows the exemplary embodiment of disk cutter arrangement 4 according to FIG. 2 without disk cutter housing 13. It is apparent from FIG. 3 that a sloping surface of clamping wedge 17 rests against the ends of a disk cutter axis 27, which rotatably fixes disk cutter 5, so that, when tensioning nut 19 is tightened, clamping wedges 17 press the ends of disk cutter axis 27 against stationary abutment parts 28 surrounding the ends of disk cutter axis 27 in the shape of a C, due to disk cutter housing 13 (not illustrated in FIG. 3), whereby disk cutter 5 is held stable. Moreover, it is apparent in the representation according to FIG. 3 that monitoring device 6 has a housing block 29, which faces away from disk cutter 5 and is manufactured as a casting or is machined from a solid material, and a housing cover 30, which is mounted on housing block 29 and faces disk cutter 5, housing block 29 and housing cover 30 forming a housing. Housing cover 30 is equipped with a raised sensor area 31, which faces a hub 32 of disk cutter 5 and is fitted with a sensor module 33 as a module. In this exemplary embodiment, sensor module 33 has a magnetic field sensor, a temperature sensor and an optional acceleration sensor. In this exemplary embodiment, a number of magnetic transmitters 34, which are provided, for example, by means of small permanent magnets introduced into hub 32 or by existing magnetic inhomogeneities in the material of disk cutter 5, are furthermore present in hub 32 of disc cutter 5 facing monitoring device 6.

Figure 4:
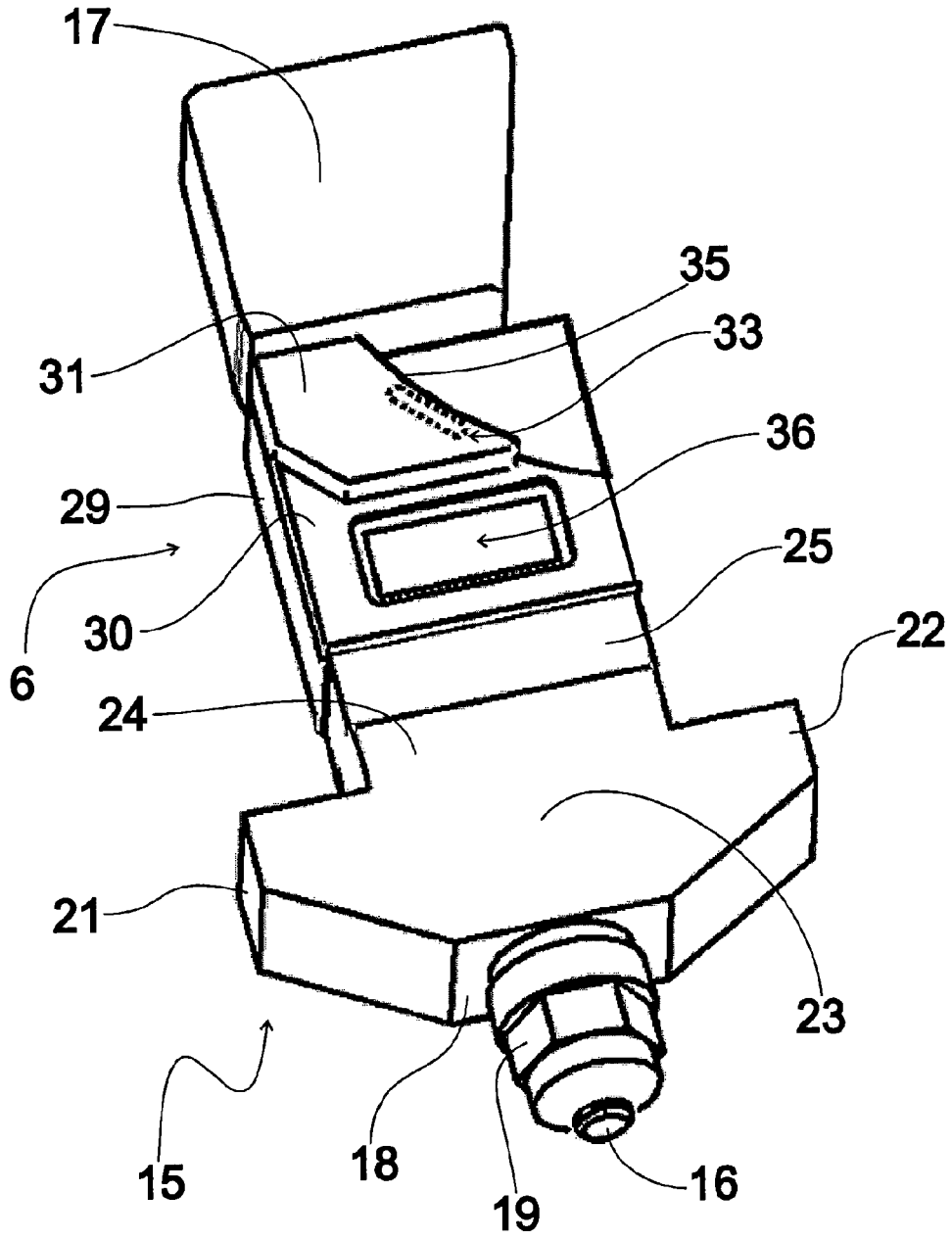
FIG. 4 shows an enlarged perspective view of the arrangement of the device according to FIG. 3.

FIG. 4 shows a perspective view of an extract of the arrangement according to FIG. 3 in the area of monitoring device 6. It is apparent from FIG. 4 that raised sensor area 31 has a curved shape on its inside 35 facing disk cutter axis 27 (not illustrated in FIG. 4) to ensure a contactless arrangement of sensor area 31 which is nevertheless situated in close proximity to hub 32 of disk cutter 5 in the axial direction. It is furthermore apparent from the representation according to FIG. 4 that housing cover 30 has an indented transmitting area 36 on the side of sensor area 31 facing clamping block 18, which thus has a relatively great distance from disk cutter 5 for a good propagation of electronic waves emitted via transmitting area 36.

Figure 5:
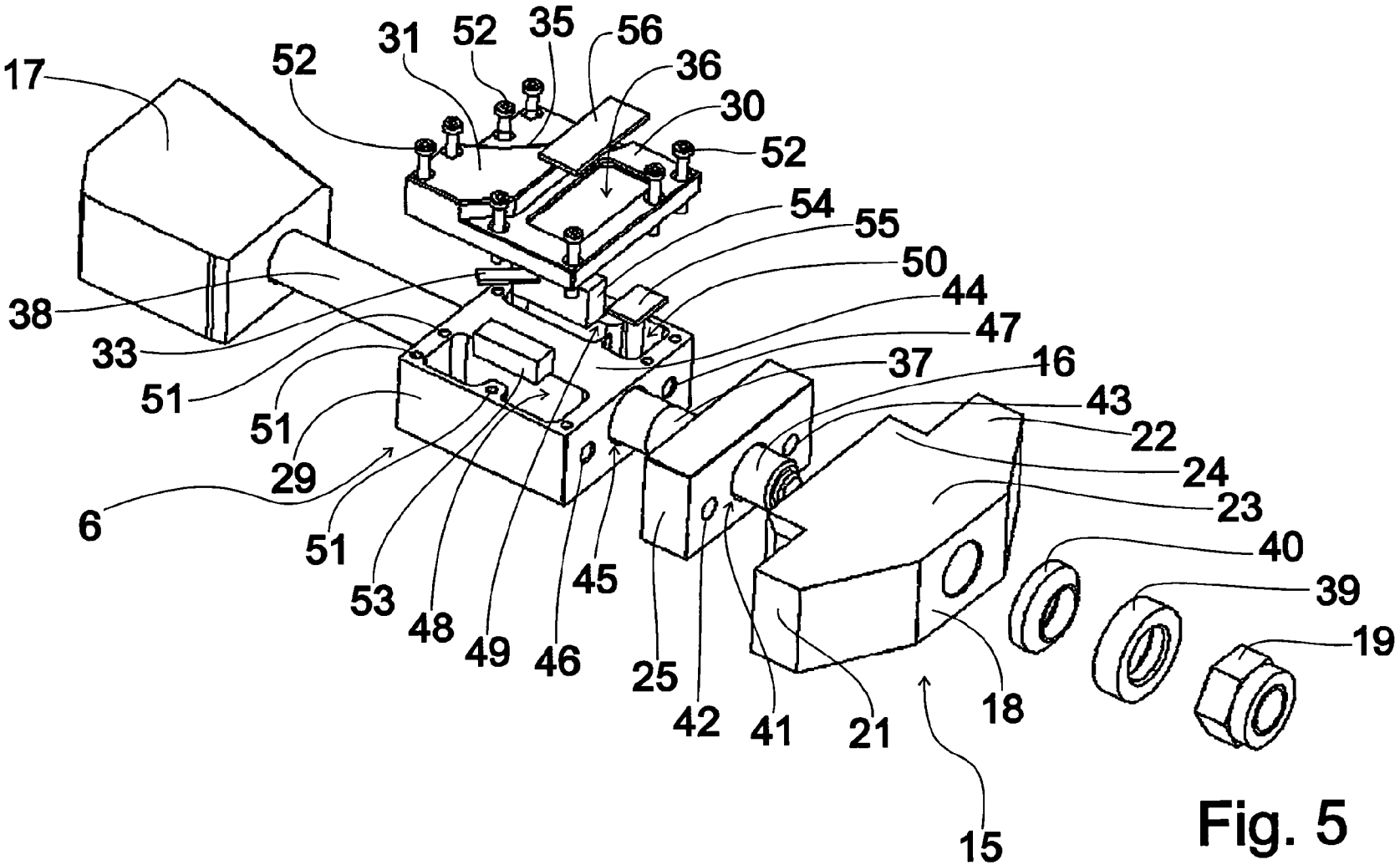
FIG. 5 shows a perspective exploded view of the arrangement according to FIG. 4.

FIG. 5 shows a perspective exploded view of the arrangement according to FIG. 4. It is apparent from FIG. 5 that clamping screw 16 has a threaded section 37, provided with an outer thread, and a smooth-walled shaft section 38, which is connected to clamping wedge 17. A ball cup 39 and a spherical disk 40 are situated between tensioning nut 19 and clamping block 18, by means of which positional tolerances may be compensated by tightening tensioning nut 19.

Spacer 25 is designed to have a central insertion recess 41, through which the free end of clamping screw 16 passes. Spacer 25 has a through-hole 42, 43 on each side of insertion recess 41, which are flush with inner threaded holes provided in terminal block 18 in a flush arrangement of spacer 25 with end section 24 of terminal block 18.

FIG. 5 furthermore shows that housing block 29 of monitoring device 6 has a cuboid structure and, in this exemplary embodiment, has a centrally located bushing base 44 situated in the central area and extending in a longitudinal direction as well as in a transverse direction of housing block 29. A shaft channel 45, through which shaft section 38 of clamping screw 16 passes, extends through bushing base 44. The diameter of shaft section 38 and shaft channel 45 are configured in such a way that housing block 29 is mounted on clamping screw 16 with a certain clearance in the radial direction. Housing block 29 has through-holes 46, 47 on both sides of shaft channel 45, which lie in the extension of the inner threaded holes as well as through-holes 42, 43 of spacer 25 in flush alignment of monitoring device 6 with spacer 25 and with end section 24 of clamping block 18, so that housing block 29 is detachably fixedly connectable to clamping block 18 using fastening screws, which are not illustrated in FIG. 5, as the sole fastening means.

A number of retaining spaces 48, 49, 50 are provided on both sides of bushing base 44 in housing block 29. In an edge wall 51 of housing block 29 which terminates retaining spaces 48, 49, 50 on the outside, a number of fastening holes 51 provided with an inner thread are present, into which cover fastening screws 52 may be screwed, which pass through cover fastening holes provided in housing cover 30 for the purpose of connecting housing cover 30 tightly to housing block 29 with the aid of a flat seal situated between housing block 29 and housing cover 30.

It is furthermore apparent from the representation according to FIG. 5 that, in addition to sensor module 33, which is situated in raised sensor area 31 and is held there by screwing and casting with a filling compound, monitoring device 6 also has a coupling module 53, a power supply module 54 and an electronic module 55 as additional modules, coupling module 53 and electronic module 55 being situated in associated retaining spaces 48, 50 and held in placed with the aid of a mechanical connecting unit located in retaining spaces 48, 50 and/or a filling compound which is at least partially filled therein. Power supply module 54 is exchangeable and is held in its retaining space 49 protected against external influences.

In this exemplary embodiment, sensor module 33 has a magnetic field sensor for detecting preferably the rotational speed, however at least the rotation or standstill of disk cutter 5, as well as a temperature sensor. Power supply module 54 is configured to autonomously supply monitoring device 6 with electrical energy.

Coupling module 53 is configured to be inductively connectable to a programming interface for the purpose of integrating monitoring device 6 into the wireless network described in connection with FIG. 1 via electronic module 55.

Finally, FIG. 5 shows, as another module, a transmitter module 56 having an antenna, which is situated by casting in transmitting area 36 of housing cover 30 with the aid of screw connections as well as with the aid of a filling compound which is highly resistant to a wide range of stresses.

Cables, which are not illustrated in FIG. 5, are provided to connect the modules formed by sensor module 33, coupling module 53, power supply module 54, electronic module 55 and antenna module 56.

Figure 6:
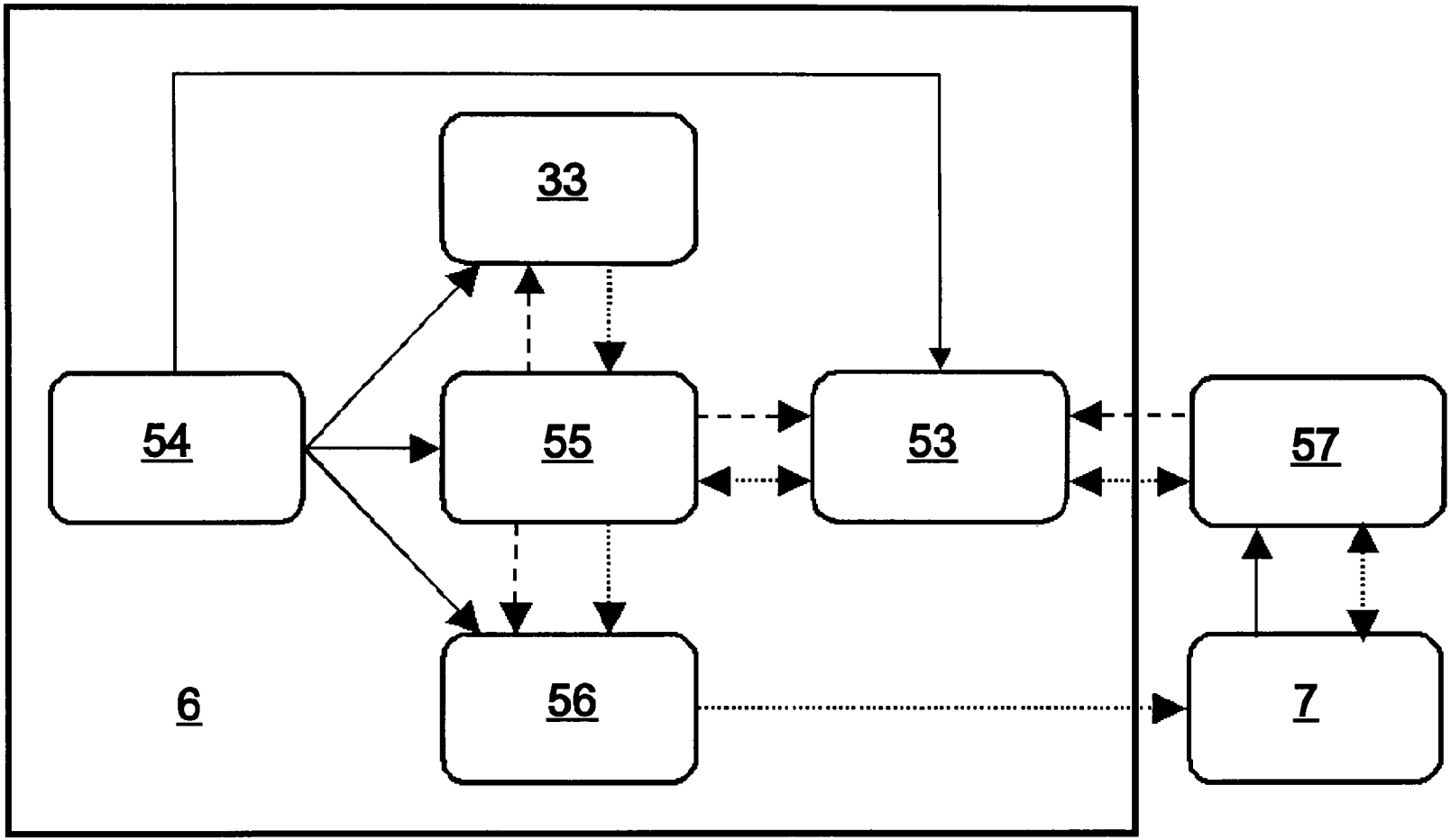
FIG. 6 shows a block diagram of the essential modules as well as other components for wireless monitoring of the state of rotation of a disk cutter.

FIG. 6 shows a block diagram of the electronic structure of monitoring device 6 and its interaction with receiver 7. For the sake of better understanding, FIG. 6 shows connections transmitting electrical energy by means of solid lines, connections transmitting control signals by means of dashed lines and connections transmitting data signals with the aid of dotted lines.

Sensor module 33, electronic module 55 and antenna module 56 may be supplied with electrical energy by power supply module 54. It is apparent from FIG. 6 that monitoring device 6 is inductively programmable energy-autonomously via coupling module 53 with the aid of a programming interface 57. Individual modules 33, 53, 54, 55, 56 are connected to each other via control signal lines and data signal lines.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A device for use in monitoring the state of rotation of a disk cutter of a shield tunnel boring machine, said device comprising:

a clamping unit; and a housing block mounted to the clamping unit, the housing block having a cuboid shape and containing at least one retaining space for accommodating a module and being closed on all sides, the housing block further including an elongated bushing base having a shaft channel extending in a longitudinal direction through the bushing base for accommodating a clamping screw shaft of the clamping unit.

2. The device of claim 1, wherein the bushing base is disposed in a central area of the housing block, and the housing block further includes at least one retaining space provided on each of two sides of the bushing base.

3. The device of claim 1, wherein at least one module is fastened to the housing block by one of a mechanical connecting unit and a filling compound, the filling compound at least partially filling a respective retaining space in which the module is disposed.

4. The device of claim 1, wherein at least one retaining space is closable with a housing cover, the housing cover detachably fastened to the housing block.

5. The device of claim 4, wherein the housing cover includes at least one module mounted thereon.

6. The device of claim 1, wherein at least one module includes at least one sensor selected from the group consisting of a magnetic field sensor, a temperature sensor, and an acceleration sensor.

7. The device of claim 1, wherein at least two modules are coupled to one another via at least one cable.

8. A disk cutter arrangement for a shield tunnel boring machine including the device of claim 1, and further comprising:

a disk cutter housing;

a disk cutter rotatable around a disk cutter axis; and a clamping screw fixing an end of the disk cutter axis in the disk cutter housing, a section of the clamping screw shaft disposed in the shaft channel, wherein a side of the housing block is disposed opposite to, and not in engagement with, a hub of the disc cutter.

9. The disk cutter arrangement of claim 8, wherein the device further includes at least one of a magnetic field sensor and a temperature sensor disposed opposite the hub.

10. The disc cutter arrangement of claim 8, wherein the housing block and an end section of a clamping block, which faces the housing block and is supported on the disk cutter housing, have substantially the same cross section.

11. The disk cutter arrangement of claim 10, further including a spacer for use in modifying an active length of the clamping unit, the spacer having an insertion recess and being disposed between the housing block and the end section of the clamping block, the spacer having substantially the same cross section as the housing block and the end section of the clamping block.

12. The disk cutter arrangement of claim 8, wherein the housing block is disposed in a form-locked manner in a retaining groove provided in the disk cutter housing.

13. The device of claim 1, wherein both the bushing base and the shaft channel are centrally located within the housing block.

* * * * *